US008104938B2

(12) United States Patent
Takada

(10) Patent No.: US 8,104,938 B2
(45) Date of Patent: Jan. 31, 2012

(54) VEHICLE HEADLAMP

(75) Inventor: Kenichi Takada, Shizuoka (JP)

(73) Assignee: Koito Manufacturing Co., Ltd, Tokyo (JP)

( * ) Notice: Subject to any disclaimer, the term of this patent is extended or adjusted under 35 U.S.C. 154(b) by 300 days.

(21) Appl. No.: 12/496,156

(22) Filed: Jul. 1, 2009

(65) Prior Publication Data

US 2010/0002457 A1 Jan. 7, 2010

(30) Foreign Application Priority Data

Jul. 3, 2008 (JP) ..... 2008-175103

(51) Int. Cl.
*F21V 1/00* (2006.01)

(52) U.S. Cl. ..... 362/509; 362/466; 362/277; 362/317; 362/513

(58) Field of Classification Search ..... 362/466, 362/509, 512, 513, 269, 277, 317, 319
See application file for complete search history.

(56) References Cited

U.S. PATENT DOCUMENTS 5,113,319 A * 5/1992 Sekiguchi et al. ..... 362/466
5,161,875 A 11/1992 Sekiguchi et al.

FOREIGN PATENT DOCUMENTS

| | | | |
|---|---|---|---|
| DE | 196 42 467 | A1 | 4/1998 |
| DE | 10 2006 031819 | A1 | 1/2008 |
| EP | 1826476 | A | 8/2007 |
| JP | 2006-040785 | A | 2/2006 |

OTHER PUBLICATIONS

Extended European Search Report issued in Application No. 09008676.0; dated Aug. 30, 2010, 7 pages.

* cited by examiner

*Primary Examiner* — John A Ward
(74) *Attorney, Agent, or Firm* — Sughrue Mion, PLLC

(57) ABSTRACT

A vehicle headlamp is provided. The vehicle headlamp includes a light source, an image forming section which forms a light image using light from the light source, and a projection lens which projects the light image. The image forming section includes a boundary shade and movable shades. Each of the movable shades is individually movable between a closed position at which the movable shade blocks a corresponding part of the light from entering the projection lens and an open position at which the movable shade allows the corresponding part of the light to enter the projection lens. The boundary shade is disposed to extend along distal ends of the respective movable shades that are arranged side by side when the movable shades are in the closed positions. When the movable shades are in the closed positions, the boundary shade forms a boundary line of the light image.

10 Claims, 12 Drawing Sheets

VEHICLE HEADLAMP

CROSS-REFERENCE TO RELATED APPLICATION

The present application claims priority from Japanese Patent Application No. 2008-175103 filed on Jul. 3, 2008, the entire content of which is incorporated herein by reference.

FIELD OF INVENTION

Apparatuses consistent with the present invention relate to a vehicle headlamp and, more particularly, to a projector-type vehicle headlamp having a movable shade.

DESCRIPTION OF RELATED ART

A related art projector-type vehicle headlamp has a movable shade (see, e.g., JP 2006-040785 A). When forming a low beam light distribution pattern using the related art vehicle headlamp, the movable shade is moved to a closed position to form a cutoff line of a low beam light distribution pattern using a distal end portion of the movable shade. When forming a high beam light distribution pattern in the related art vehicle headlamp, the movable shade is retracted to an open position to irradiate a region above the cutoff line.

For the driver of the vehicle, forward visibility is improved when the region above the cutoff line is irradiated in addition to the low beam light distribution pattern. However, if the vehicle is driven with the irradiation to the region above the cutoff line being maintained, a glare may be given to other drivers of vehicles running ahead such as oncoming vehicles and preceding vehicles.

SUMMARY OF INVENTION

In view of the foregoing, illustrative aspects of the present invention provide a vehicle headlamp which can suitably improve forward visibility for a driver without giving a glare to other drivers of vehicles running ahead.

According to an illustrative aspect of the present invention, a vehicle headlamp is provided. The vehicle headlamp includes a light source, an image forming section which forms a light image using light from the light source, and a projection lens which projects the light image. An optical axis extends from the light source and passes through the projection lens. The image forming section includes a plurality of movable shades and a boundary shade. The movable shades are arranged side by side, and each of the movable shades is individually movable between a closed position at which the movable shade blocks a corresponding part of the light from entering the projection lens and an open position at which the movable shade allows the corresponding part of the light to enter the projection lens. Each of the movable shades has a distal end. The boundary shade is disposed to extend along the distal ends that are arranged side by side when the plurality of movable shades are in the closed positions. When the plurality of movable shades are in the closed positions, the boundary shade forms a boundary line of the light image.

Other aspects and advantages of the invention will be apparent from the following description, the drawings and the claims.

DETAILED DESCRIPTION OF EXEMPLARY EMBODIMENTS OF INVENTION

Hereinafter, exemplary embodiments of the present invention will be explained in detail with reference to the drawings. The following exemplary embodiments are examples only and do not limit the scope of the present invention as defined by the claims.

First Exemplary Embodiment

Figure 1:
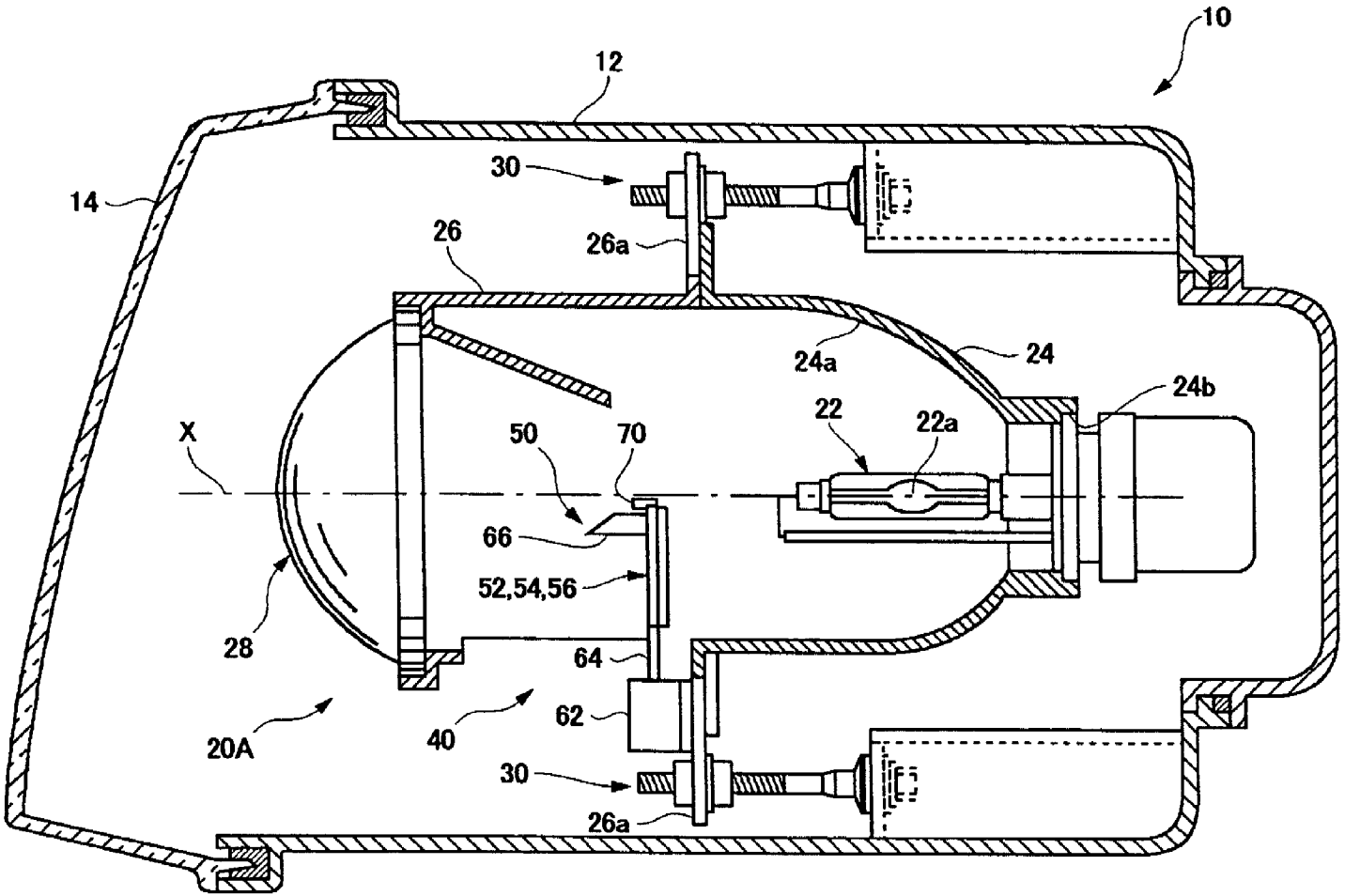
FIG. 1 is a sectional view a vehicle headlamp according to a first exemplary embodiment of the present invention.

FIG. 1 is a sectional view a vehicle headlamp 10 according to a first exemplary embodiment. The vehicle headlamp 10 has a lamp body 12, a transparent cover 14, and a lamp unit 20A. A left-hand side of FIG. 1 is the front side of the headlamp 10 and a right-hand side of FIG. 1 is the rear side of the headlamp 10. FIG. 1 is the sectional view of the vehicle headlamp 10 taken along a vertical plane which includes an optical axis X of the lamp unit 20A, and is viewed from the left of the headlamp 10.

The lamp body 12 is formed in a box shape having an opening. The transparent cover 14 is made of a transparent resin or glass, and is formed in a saucer shape. An edge portion of the transparent cover 14 is fixed to an opening portion of the lamp body 12, whereby a lamp chamber is formed as a space surrounded by the lamp body 12 and the transparent cover 14.

A holder 26 has a plurality of attaching portions 26*a* which project radially outward at a location in a vicinity of joining portions where the holder 26 is joined to a reflector 24. The lamp unit 20A is accommodated inside the lamp chamber. More specifically, the attaching portions 26*a* are attached to the lamp body 12 via a mounting mechanism 30 having bolts and nuts, whereby the lamp unit 20A is fixed in place inside the lamp chamber. An orientation of the optical axis X of the lamp unit 20A can be adjusted by adjusting positions where the nuts are fastened. That is, the mounting mechanism 30 functions as aiming device.

The lamp unit 20A has a light source bulb 22, the holder 26, a projection lens 28 and an image forming section 40. The light source bulb 22 may be, for example, a discharge bulb such as a metal halide bulb which has a discharge light emitting portion thereinside as a light source 22*a*. Alternatively, the light source bulb 22 may be, for example, an incandescent lamp having a filament, e.g., a halogen lamp. The projection lens 28 is a planoconvex aspheric lens having a convex front surface and a flat rear surface. The projection lens 28 projects a light image, which is formed on a rear focal plane thereof, as an inverted image toward the front of the vehicle headlamp 10. The holder 26 is formed in a cylindrical shape which is opened on respective ends, and the projection lens 28 is attached to the front end of the holder 26.

In this description, an image projected through the projection lens 28 will be explained as an image projected on an imaginary vertical screen which is disposed, for example, 25 meters ahead of the vehicle on which the headlamp 10 is mounted. However, an imaginary plane on which the image is projected is, of course, not limited to a vertical plane, and may be a horizontal plane which is assumed as including a road surface.

The image forming section 40 includes the reflector 24 and a shade unit 50. The reflector 24 is formed in a cup shape, and an insertion hole 24*b* is formed in a bottom portion thereof. The light source bulb 22 is inserted into the insertion hole 24*b* and is fixed in place. An inner surface of the reflector 24 is mirror finished to form a reflecting surface 24*a*. A front end of the reflector 24 is joined to the rear end of the holder 26, whereby the reflector 24 and the holder 26 are fixed to each other such that the light source 22*a* is located on the optical axis X. The reflecting surface 24*a* of the reflector 24 reflects light from the light source 22*a* to form a light image on the rear focal plane of the projection lens 28.

The shade unit 50 partially shields the light which is reflected by the reflector 24 toward the projection lens 28. The shade unit 50 has a first movable shade 52, a second movable shade 54, a third movable shade 56, solenoids 62, an auxiliary reflector 66, and a boundary shade 70.

The solenoids 62 are fixed to one of the attaching portions 26*a* which is provided on a lower side of the holder 26. Each of the solenoids 62 has a plunger 64. The solenoids 62 are disposed such that the respective plungers 64 extend vertically upward from the corresponding solenoids 62.

Figure 2:
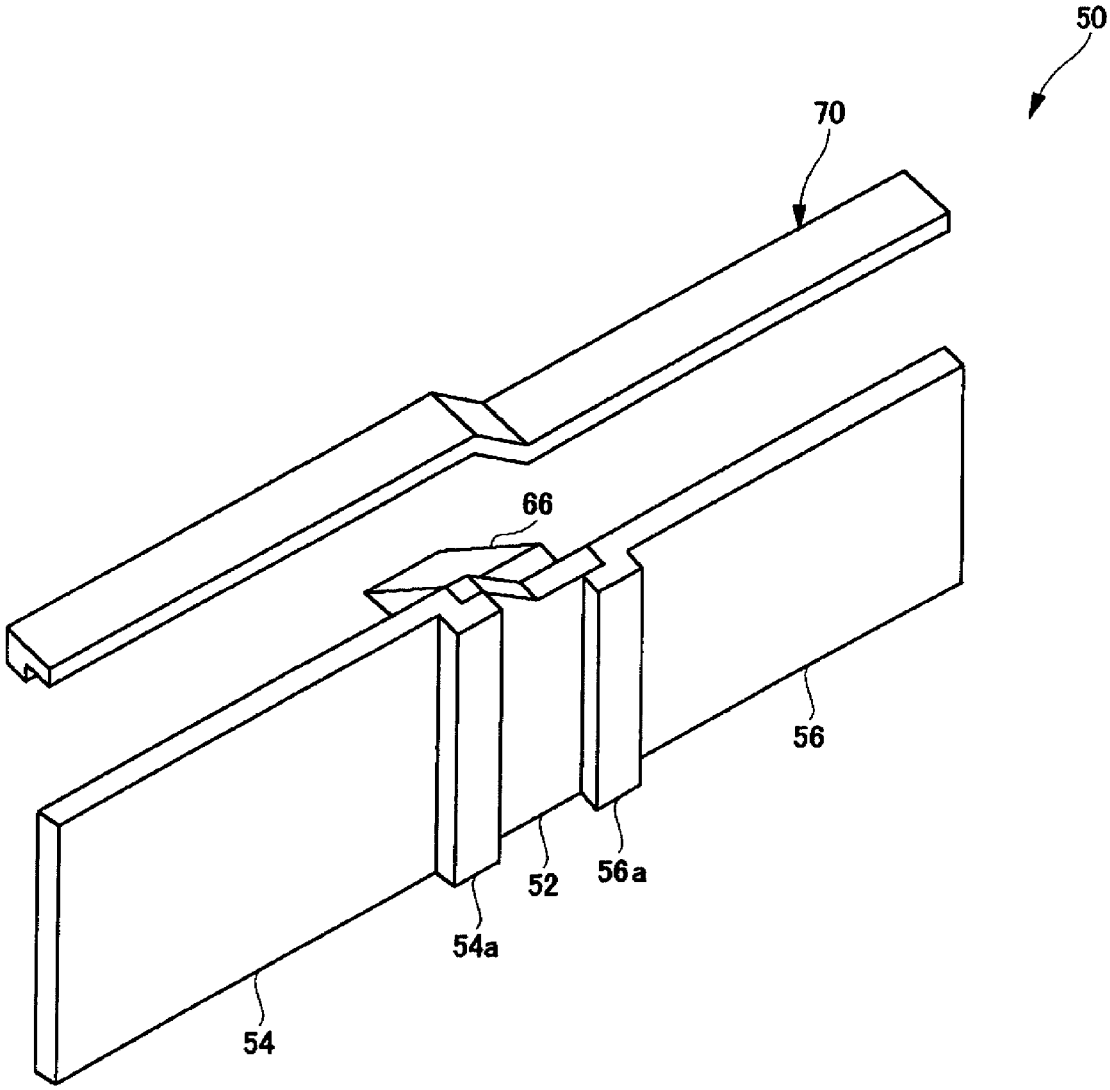
FIG. 2 is a partial perspective view of a shade unit of the vehicle headlamp of FIG. 1.

FIG. 2 is a partial perspective view of the shade unit 50. The boundary shade 70 is formed in a shape of an elongated narrow plate, and there is a level difference on respective sides of an inclined portion which is provided substantially at a center of the boundary shade 70 in a longitudinal direction of the boundary shade 70. Respective ends of the boundary shade 70 are immovably fixed to the holder 26.

The first movable shade 52, the second movable shade 54, and the third movable shade 56 are formed in rectangular shapes having different outlines. The auxiliary reflector 66 is fixed to a front surface of the first movable shade 52. The second movable shade 54 is disposed on the left of the first movable shade 52, and the third movable shade 56 is disposed on the right of the first movable shade 52.

The second movable shade 54 has an overlap portion 54*a* which is recessed toward the rear. The overlap portion 54*a* is linearly formed, along a vertical direction, on a right end portion of the second movable shade 54. The second movable shade 54 is disposed such that a front surface of the overlap portion 54*a* abuts a rear surface of a left end portion of the first movable shade 52. The overlap portion 54*a* suppresses a leakage of light from a gap between the first movable shade 52 and the second movable shade 54.

Likewise, the third movable shade 56 has an overlap portion 56*a* which is recessed toward the rear. The overlap portion 56*a* is linearly formed, along the vertical direction, on a left end portion of the third movable shade 56. The third movable shade 56 is disposed such that a front surface of the overlap portion 56*a* abuts a rear surface of a right end portion of the first movable shade 52. The overlap portion 56*a* suppresses a leakage of light from a gap between the first movable shade 52 and the third movable shade 56. Instead of providing the overlap portions on the second movable shade 54 and the third movable shade 56, the overlap portions may alternatively be provided on the first movable shade 52.

Figure 3:
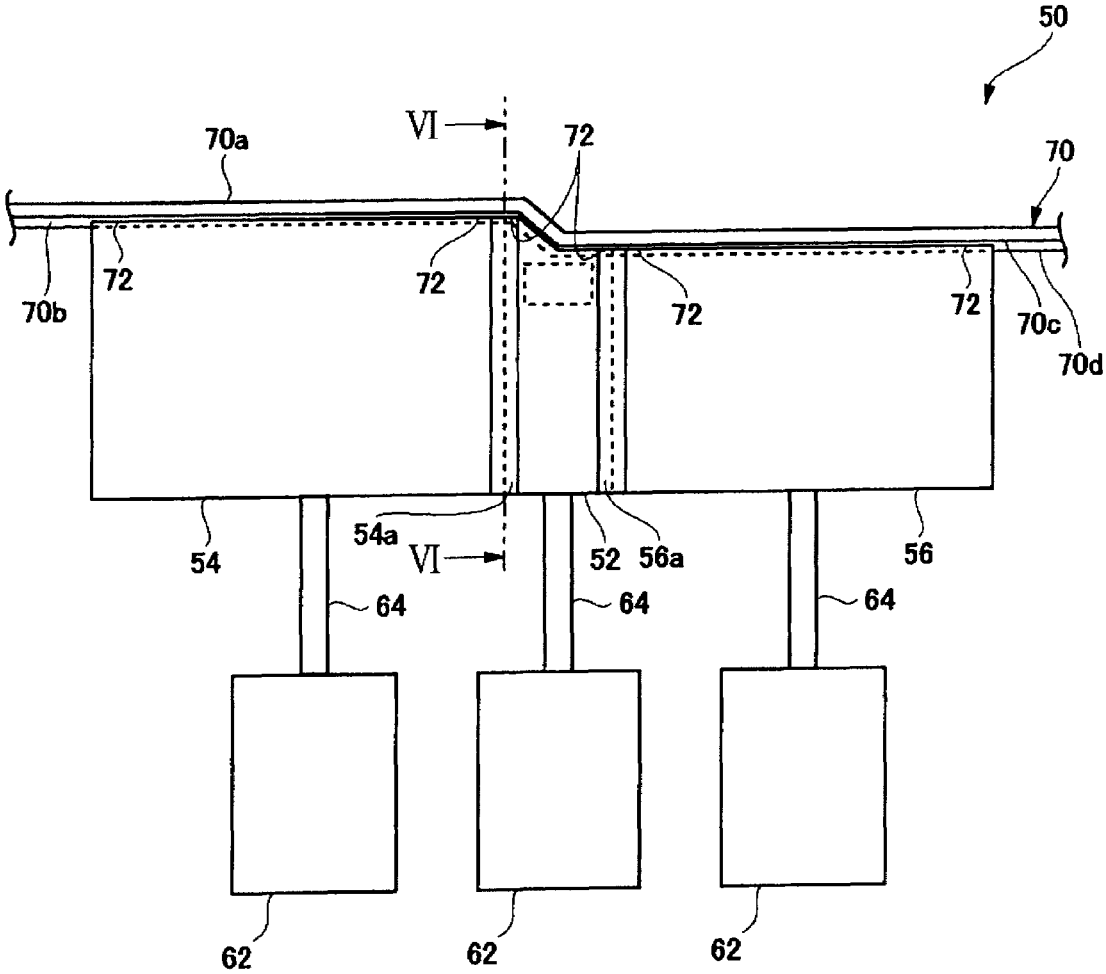
FIG. 3 is a back view of the shade unit of FIG. 2.

FIG. 3 is a back view of the shade unit 50. The boundary shade 70 is disposed to extend in a horizontal direction. The boundary shade 70 has an upper surface (a boundary surface 70*a*) and a lower surface. The boundary surface 70*a* has a left portion, a right portion, and an inclined portion which is disposed between the left and right portions substantially at the center of the boundary surface 70*a*. The left portion horizontally extends from a left end of the boundary surface 70*a* to the inclined portion. The right portion horizontally extends, at a height lower than the left portion, from a right end of the boundary surface 70*a* to the inclined portion.

The lower surface of the boundary shade 70 is stepped down from the rear to the front, and has a first lower surface 70*c* on the rear side and a second lower surface 70*d* on the front side. A thickness from the boundary surface 70*a* to the first lower surface 70*c* is uniform along the entire length of the boundary shade 70. A thickness from the boundary surface 70*a* to the second lower surface 70*d* is also uniform along the entire length of the boundary shade 70. Like the boundary surface 70*a*, each of the first lower surface 70*c* and the second lower surface 70*d* has a left portion, a right portion, and an inclined portion between the left and right portions.

An upper end portion of the first movable shade 52 has an inclined portion which is formed to match the inclined portion of the first lower surface 70*c* of the boundary shade 70. The first movable shade 52, the second movable shade 54 and the third movable shade 56 are arranged side by side in a right-and-left direction such that upper end portions (distal end portions) thereof match the first lower surface 70*c* of the boundary shade 70 respectively.

Each of the movable shades 52, 54, 56 is upwardly biased by a spring (not shown) toward the first lower surface 70*c*. Closing stoppers 72 are attached to the first lower surface 70*c* at locations corresponding to right upper ends and a left upper ends of the respective movable shades 52, 54, 56. Each of the movable shades 52, 54, 56 is biased upward to touch the respective closing stoppers 72, whereby an upward movement thereof is restricted. When in abutment with the closing stoppers 72, each of the movable shades 52, 54, 56 blocks a corresponding part of the light, which is reflected by the reflector 24, from entering the projection lens 28. Hereinafter, for each of the movable shades 52, 54, 56, a position where the movable shade is in abutment with the closing stoppers 72 on the first lower surface 70*c* of the boundary shade 70 is referred to as a "closed position." The closing stoppers 72 may be made of a cushioning material in order to suppress noise from the movable shades 52, 54, 56.

The boundary shade has a vertical overlap portion 70*b* between the first lower surface 70*c* and the second lower surface 70*d*. When the movable shades 52, 54, 56 are in their closed positions, the overlap portion 70*b* is located in front of a gap between the first lower surface 70*c* and the respective movable shades 52, 54, 56, so that the boundary shade 70 and the movable shades 52, 54, 56 overlap each other in a direction along the optical axis X. Accordingly, when the movable shades 52, 54, 56 are in the closed positions, the overlap portion 70*b* suppresses a leakage of light toward the projection lens 28 from the gap between the upper ends (the distal ends) of the movable shades and the first lower surface 70*c* of the boundary shade 70. Instead of providing the overlap portion on the boundary shade 70, overlap portions may be provided on the respective movable shades 52, 54, 56 so as to suppress a leakage of light from the gap between the boundary shade 70 and the respective movable shades 52, 54, 56.

The number of solenoids 62 is set to correspond to the number of movable shades. Thus, in this exemplary embodiment, the number of solenoids 62 is set to three so as to correspond to the first movable shade 52, the second movable shade 54 and the third movable shade 56. A lower end portion of each of the movable shades 52, 54, 56 is coupled to an upper end portion of a plunger 64 of a respective one of the solenoids 62.

When supplied with current (hereinafter, "when activated"), the solenoid 62 pulls down the plunger 64, so that the corresponding one of the movable shades 52, 54, 56 is moved downward together with the plunger 64. When the supply of current is stopped (hereinafter, referred to as "deactivated"), the solenoid 62 releases the plunger 64 from pulling downward, whereby the corresponding one of the movable shades 52, 54, 56 moves back to the closed position due to the biasing force of the spring.

Figure 4:
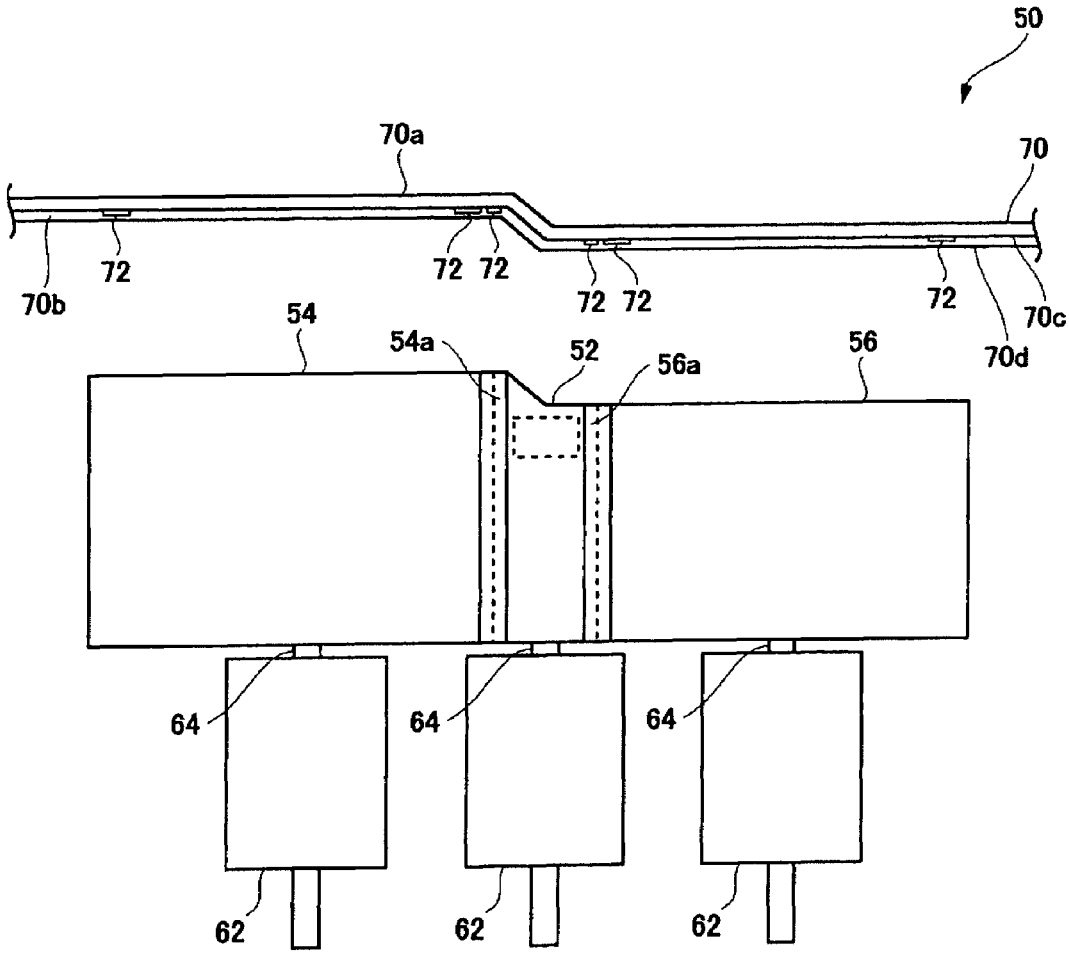
FIG. 4 is another back view of the shade unit of FIG. 2 in which solenoids are activated.

FIG. 4 is a back view of the shade unit 50 in which all the solenoids 62 are activated. The shade unit 50 has an opening stopper (not shown). Each of the movable shades 52, 54, 56 is restricted from continuing to move downward by hitting the opening stopper. When the movable shades 52, 54, 56 are moved downwards, each corresponding part of light, which is reflected by the reflector 24, is allowed to enter the projection lens 28. Hereinafter, for each of the movable shades 52, 54, 56, a position where the movable shade is in abutment with the opening stopper is referred to as an "open position."

As described above, each of the movable shades 52, 54, 56 is movable between the closed position and the open position in the vertical direction, e.g., in a direction perpendicular to the optical axis X. The movable shades 52, 54, 56 may not necessarily be moved in the vertical direction, and may be moved in a direction having a certain angle with respect to the vertical direction. Further, the movable shades 52, 54, 56 may be moved in a direction which is not perpendicular to the optical axis X but intersecting the optical axis X.

Figure 5:
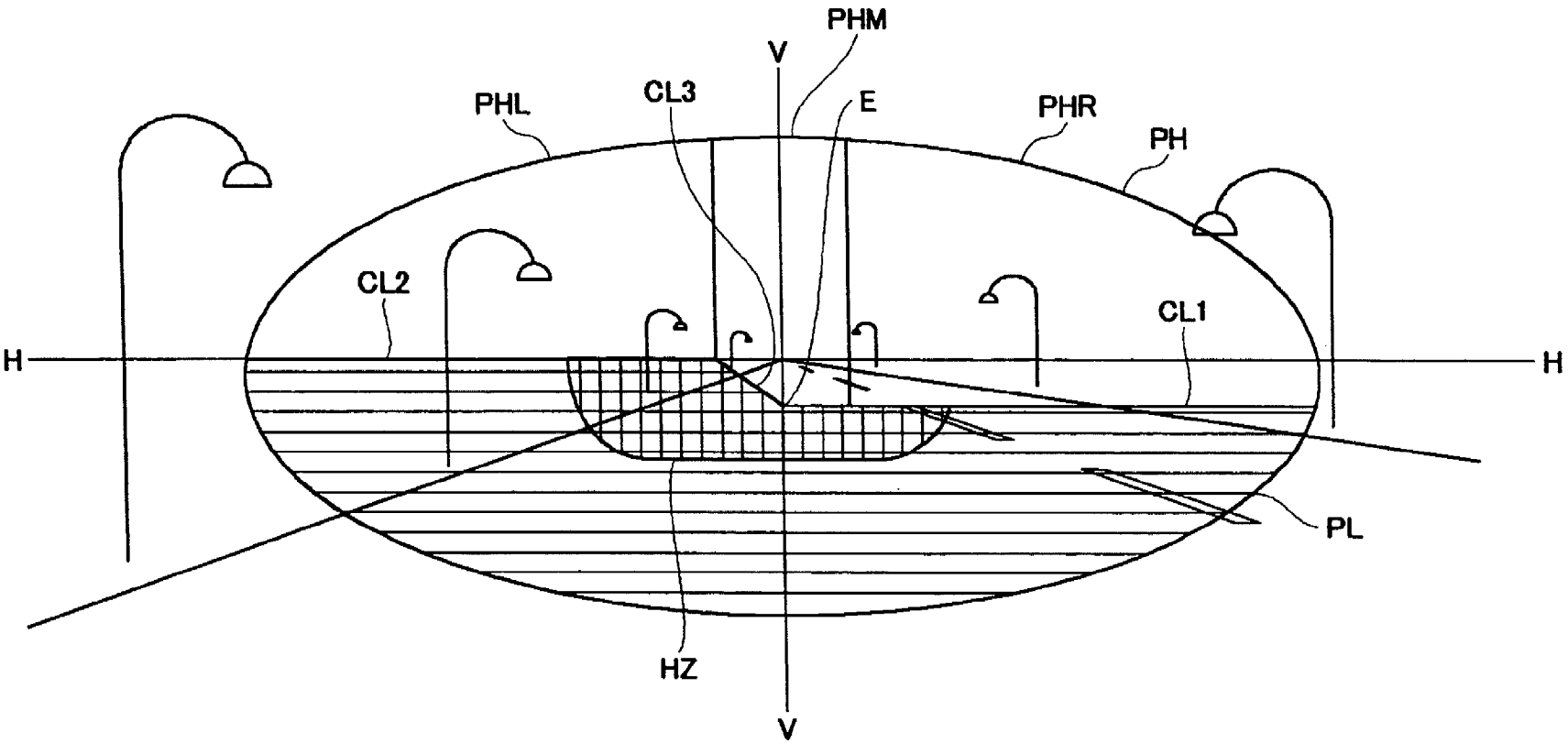
FIG. 5 is a diagram illustrating light distribution patterns to be formed by irradiating an imaginary vertical screen with light projected from the vehicle headlamp of FIG. 1.

FIG. 5 is a diagram illustrating light distribution patterns formed by irradiating the imaginary vertical screen with light projected from the vehicle headlamp 10.

The headlamp 10 is capable of producing a low beam light distribution pattern PL and a high beam light distribution pattern PH. The low beam light distribution pattern PL is for a left-hand traffic, and has a cutoff line along an upper edge thereof. The cutoff line includes a first cutoff line CL1, a second cutoff line CL2, and a third cutoff line CL3. The first cutoff line CL1 and the second cutoff line CL2 extend in a horizontal direction at different levels on respective sides of a line V-V which passes through a vanishing point H-V straight ahead of the vehicle on which the headlamp 10 is mounted. The first cutoff line CL1 extends in the horizontal direction in a region on the right of the line V-V and below the line H-H, and is used as a cutoff line for an oncoming lane. The third cutoff line CL3 extends obliquely upward to the left at an angle of about 15° from a left end of the first cutoff line CL1. The second cutoff line CL2 extends in the horizontal direction on the line H-H in a region on the left of the intersection point of the third cutoff line CL3 and the line H-H, and is used as a cutoff line for a lane in which the vehicle itself is traveling.

An elbow point E is an intersection point of the first cutoff line CL1 and the line V-V, and is located in a position about 0.5° to 0.6° below the vanishing point H-V. A hot zone HZ is a high luminous intensity zone, and is formed around the elbow point E, primarily on the left of the elbow point E.

The high beam light distribution pattern PH is formed above the cutoff line of the low beam light distribution pattern PL in addition to the low beam light distribution pattern PL. The high beam light distribution pattern PH is divided into three sections, namely, a middle section PHM, a right section PHR and a left section PHL, by two vertical boundary lines on respective sides of the line V-V. The middle section PHM is formed when the first movable shade 52 is in the open position. The right area PHM is formed when the second movable shade 54 is in the open position. The left section PHL is formed when the third movable shade 56 is in the open position.

When all of the movable shades 52, 54, 56 are in the closed positions, the vehicle headlamp 10 produces the low beam light distribution pattern PL, and the cutoff line of the low beam light distribution pattern PL is formed by the boundary surface 70*a* of the boundary shade 70.

Here, it may be possible to form the cutoff line by the upper ends of the movable shades 52, 54, 56 without providing the boundary shade 70. However, because each of the movable shades 52, 54, 56 is moved in the vertical direction, there may be a misalignment of the upper ends when the movable shades 52, 54, 56 are in the closed positions. Even though this misalignment may be a small misalignment in the shade unit 50, the misalignment is more recognizable on the imaginary vertical screen as an obvious misalignment of the cutoff line. To the contrary, because the shade unit 50 of the exemplary embodiment includes the boundary shade 70, the cutoff line can accurately be formed regardless of the misalignment of the plurality of movable shades 52, 54, 56.

When all of the movable shades 52, 54, 56 are in the open positions, the vehicle headlamp 10 produces the high beam light distribution pattern PH in addition to the low beam light distribution pattern PL. The vehicle on which the headlamp 10 is mounted may have a high beam switch (not shown), so that when the high beam switch is turned on by the driver, the solenoids 62 are activated to move all of the movable shades 52, 54, 56 to the open positions.

The vehicle may also have an intermediate beam switch (not shown). When the intermediate beam switch is turned on by the driver, an intermediate beam mode is initiated. In the intermediate beam mode, when there is a vehicle running ahead, such as an oncoming vehicle and/or a preceding vehicle, in a region corresponding to one or more of the right section PHR, the middle section PHM and the left section PHL, one or more of the movable shades 52, 54, 56 corresponding to the one or more of the right section PHR, the middle section PHM and the left section PHL is moved to or maintained in the closed position, and the other of the movable shades 52, 54, 56 is moved to or maintained in the open position. Accordingly, it is possible to improve forward visibility for the driver without giving a glare to the other driver of the vehicle running ahead.

More specifically, the vehicle on which the vehicle headlamp 10 is mounted may also have a camera (not shown) and a control unit (not shown). The control unit has, for example, a central processing unit (CPU) which executes various arithmetic operations, a read only memory (ROM) in which various control programs are stored, and a random access memory (RAM) which is used as a work area for storing data and executing programs, to control the vehicle headlamp 10. The camera has, for example, an imaging device such as a Charge Coupled Device (CCD) sensor or a Complementary Metal Oxide Semiconductor (CMOS) sensor, to capture images of a region ahead of the vehicle and to generate image data thereof. The camera is coupled to the control unit, and the image data is output to the control unit.

When the intermediate beam switch is turned on by the driver, a signal is output to the control unit to initiate a light irradiation control of the headlamp 100. During the intermediate beam mode, the control unit analyzes the image data from the camera, and determines whether there is a vehicle running ahead, e.g., an oncoming vehicle whose headlamps are turned on. When it is determined that there is a vehicle running ahead, the control unit then determines a position of the vehicle running ahead. A position of an oncoming vehicle may be determined, for example, from the positions of the headlamps in the analyzed image data. When the position of the vehicle running ahead is determined, the control unit then determines whether the vehicle running ahead is in a region corresponding to any of the middle section PHM, the right section PHR, and the left section PHL. When it is determined that the vehicle running ahead is in a region corresponding to one or more of the sections PHM, PHR, PHL, the control unit deactivates, or maintain in a deactivated condition, one or more of the solenoids 62 coupled to the corresponding movable shades 52, 54, 56 so that the corresponding movable shades 52, 54, 56 are moved to or maintained in the closed positions, and activates or maintains in an activated condition the other of the solenoids 62 so that the other of the movable shades 52, 54, 56 are moved to or maintained in the open positions.

Figure 6:
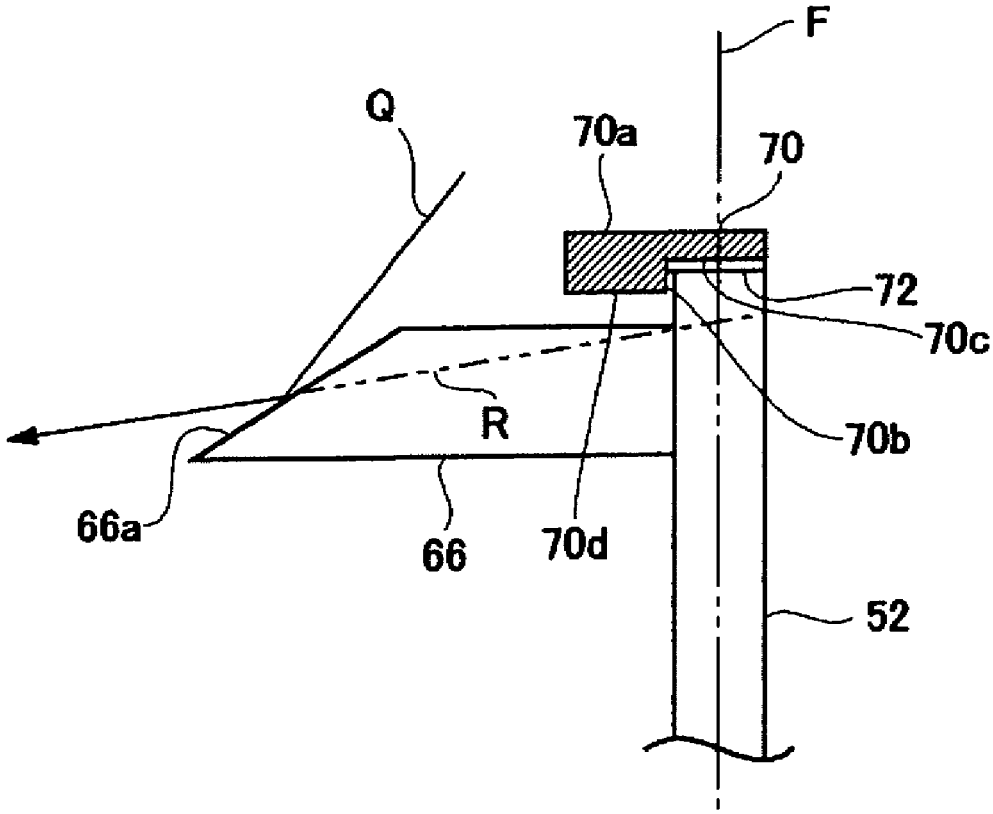
FIG. 6 is a sectional view taken along a line VI-VI in FIG. 3.

FIG. 6 is a sectional view taken along the line VI-VI in FIG. 3. The auxiliary reflector 66 is formed in a quadrangular prism shape, and is attached to the front surface of the first movable shade 52 at one end thereof. The auxiliary reflector 66 has an auxiliary reflecting surface 66*a* which is inclined downward toward the front. The auxiliary reflecting surface 66*a* may be formed by an aluminum deposition. Inside the lamp unit 20A, there is an optical path Q of light which is reflected by an upper part of the reflecting surface 24*a* of the reflector 24 to pass above the boundary surface 70*a*. The auxiliary reflecting surface 66*a* reflects the light, which is incident thereon along the optical path Q, toward the projection lens 28. According to this configuration, the light enters the projection lens 28 as if it is incident on the projection lens 28 along an imaginary optical path R which passes a focal plane F of the projection lens 28 at a position below the boundary surface 70*a*.

When the first movable shade 52 is in the closed position, light incident on the focal plane F of the projection lens 28 below the boundary surface 70*a* is blocked. However, because the auxiliary reflecting surface 66*a* is provided, a light image can be formed below the boundary surface 70*a* even when the first movable shade 52 is in the closed position. The auxiliary reflecting surface 66*a* thus makes it possible to irradiate, when the first movable shade 52 is in the closed position so that the middle section PHM of the high beam light distribution pattern PH is not formed, an overhead sign region, which is above the cutoff line CL and around the line V-V, with the light reflected by the auxiliary reflecting surface 66*a*.

The second lower surface 70*d* of the boundary shade 70 is mirror finished by, for example, an aluminum deposition to function as a reflecting face. When one of the movable shades 52, 54, 56 is in the closed position, the corresponding part of the light is blocked from entering the projection lens 28 and the leakage of light from a gap between the one of the movable shade 52, 54, 56 and the boundary shade 70 is suppressed by the overlap portion 70*b*. On the other hand, when the one of the movable shades 52, 54, 56 is in the open position, the corresponding part of light is partially reflected by the second lower surface 70*d* so as to be incident on the projection lens 28, thereby suppressing a part of a projected image that corresponds to the boundary shade 70 from being dark.

Second Exemplary Embodiment

Figure 7:
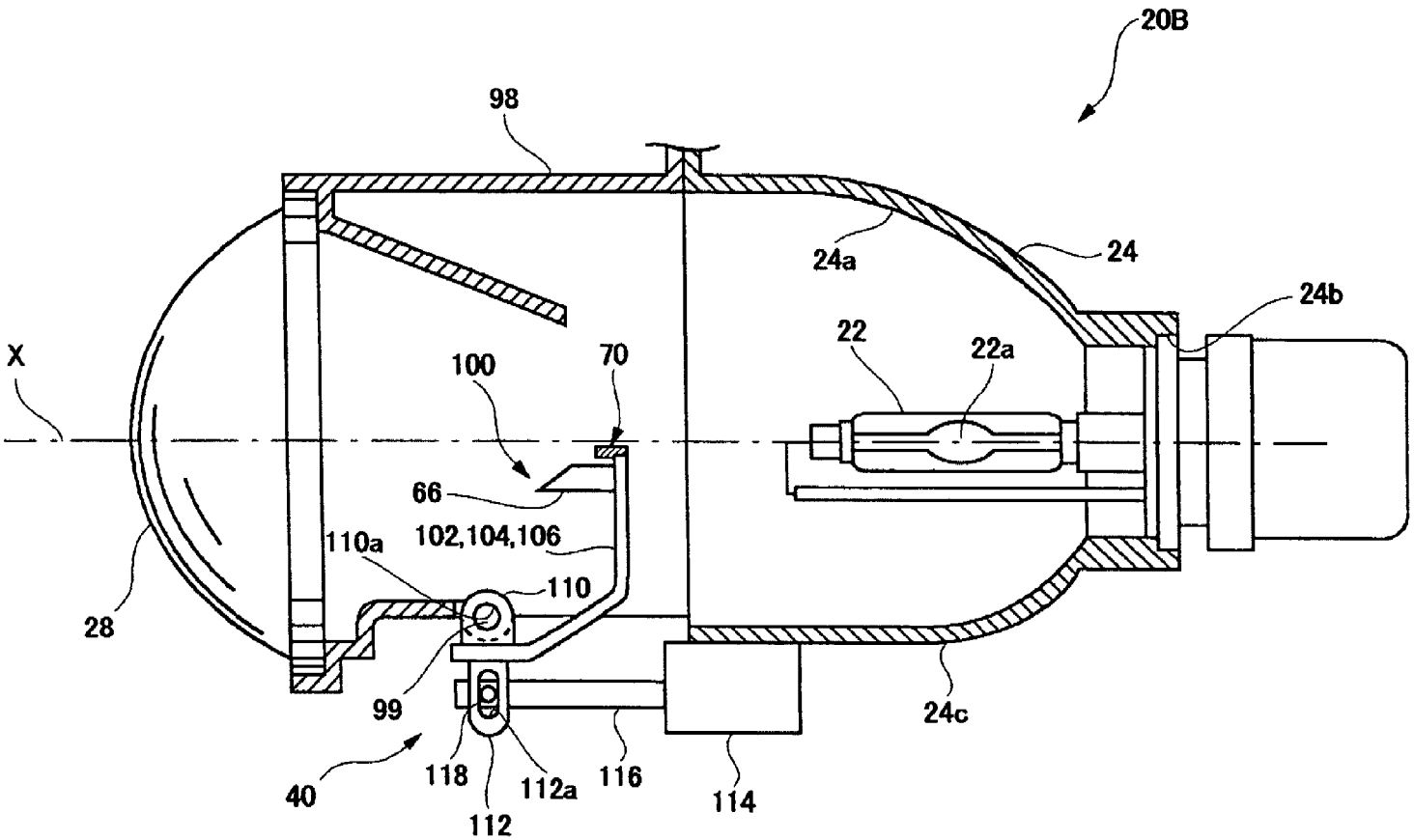
FIG. 7 is a sectional view of a lamp unit according to a second exemplary embodiment of the present invention.

FIG. 7 is a sectional view of a lamp unit 20B according to a second exemplary embodiment of the present invention. The sectional view is taken along a vertical plane including an optical axis X, and is viewed from the left of the lamp unit 20B. Hereinafter, portions of the lamp unit 20B that are similar to those of the lamp unit 20A will be designated by the same reference numerals, and detailed explanation thereof will be omitted.

The lamp unit 20B has a similar configuration to that of the lamp unit 20A, except that a shade unit 100 is provided instead of the shade unit 50 and that a holder 98 is provided instead of the holder 26. The shade unit 100 includes a boundary shade 70, a first movable shade 102, a second movable shade 104, a third movable shade 106 and solenoids 114.

Figure 8:
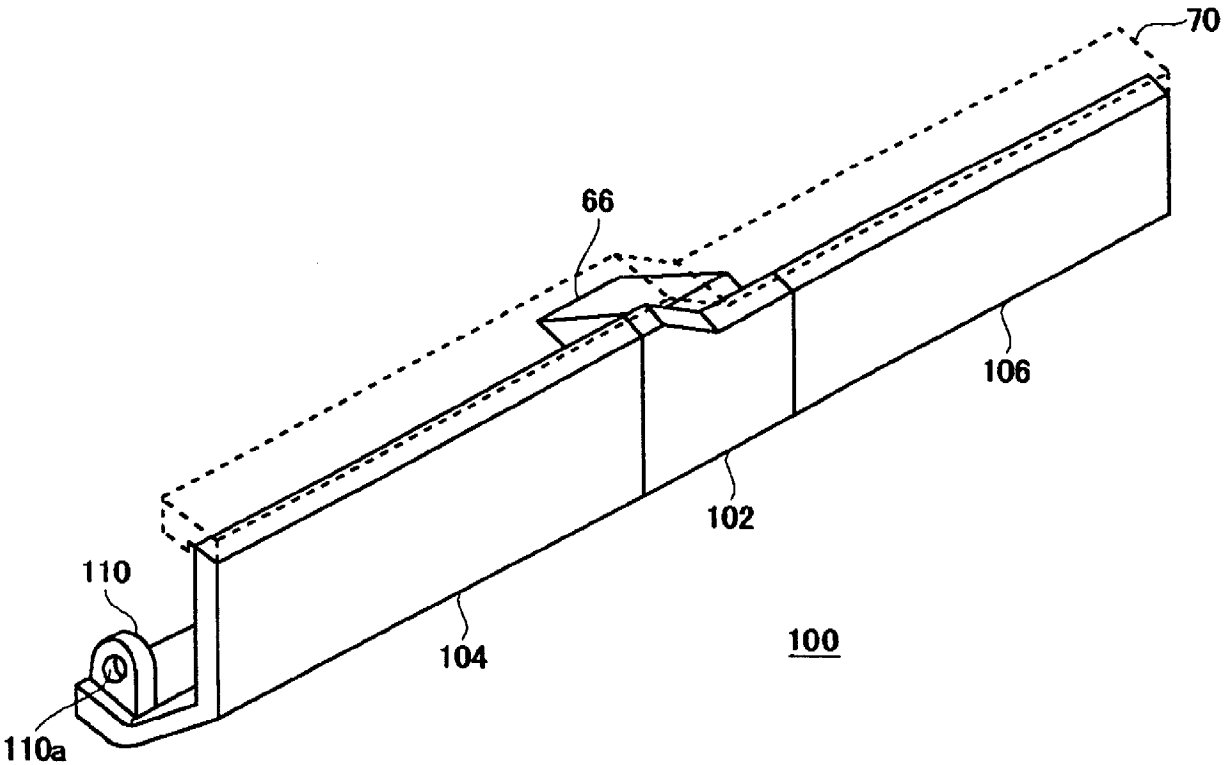
FIG. 8 is a partial perspective view of a shade unit of the lamp unit of FIG. 7.

FIG. 8 is a partial perspective view of the shade unit 100. The first movable shade 102, the second movable shade 104 and the third movable shade 106 are formed in rectangular shapes having different outlines. A lower part of each of the movable shades 102, 104, 106 is bent toward the front. An auxiliary reflector 66 is fixed to a front surface of the first movable shade 102. The second movable shade 104 is disposed on the left of the first movable shade 102, and the third movable shade 106 is disposed on the right of the first movable shade 102.

An upper end of the first movable shade 102 has an inclined portion which matches an inclined portion of a first lower surface 70*c* of the boundary shade 70. The first movable shade 102, the second movable shade 104 and the third movable shade 106 are arranged side by side in a right-and-left direction such that upper ends (distal ends) thereof match the first lower surface 70*c*.

The lower part of each of the movable shades 102, 104, 106 has support portions 110 on right and left sides. Each of the support portions is formed with a shaft hole 110*a* penetrating through the support portion 110 in the right-and-left direction.

As shown in FIG. 7, an opening is formed in a lower part of the holder 98, where a rotational shaft 99 is attached to the holder 98 to horizontally extend in a direction perpendicular to the optical axis X. The rotational shaft 99 is inserted through the shaft holes 110*a* of the support portions 110 of each of the movable shades 102, 104, 106. Accordingly, the movable shades 102, 104, 106 are individually rotatable about the rotational shaft 99.

Figure 9:
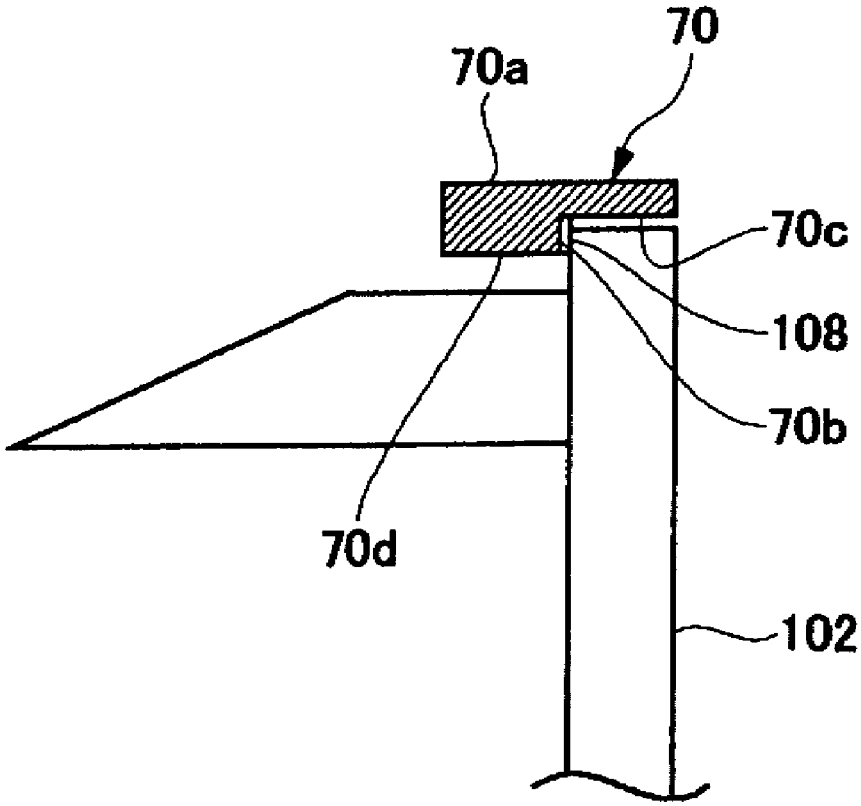
FIG. 9 is a left side view of a first movable shade of the lamp unit of FIG. 7.

FIG. 9 is a left side view of the first movable shade 102. In the second exemplary embodiment, closing stoppers 72 are not provided on the first lower surface 70*c* of the boundary shade 70. Instead, a plurality of closing stoppers 108 are provided on a overlap portion 70*b* of the boundary shade 70. The positions of the closing stoppers 108 in the right-and-left direction are similar to those of the closing stoppers 72 in the first exemplary embodiment. Each of the movable shades 102, 104, 106 is biased to rotate toward the front by a coil spring (not shown), and when the movable shade hits the closing stoppers 108, the forward rotation thereof is restricted. For each of the movable shades 102, 104, 106, a position where the movable shade is in abutment with the closing stoppers 108 is referred to as a "closed position."

As shown in FIG. 7, a coupling member 112 is provided on a lower surface of each of the movable shades 102, 104, 106. Each of the coupling members 112 is formed with a slot 112*a* penetrating through the connecting portion 112 in the right-and-left direction. The slot 112*a* is provided to extend in the vertical direction when the corresponding one of the movable shades 102, 104, 106 is in the closed position.

Each of the solenoids 114 is associated with a corresponding one of the movable shades 102, 104, 106. The solenoids 114 are fixed to a lower surface 24*c* of a reflector 24 such that respective plungers 116 extend to the front.

A pin 118 is fixed to a distal end portion of the plunger 116 to extend in the right-and-left direction. The pin 118 is inserted into the slot 112*a* of the corresponding coupling member 112. When the solenoid 114 is activated, the solenoid 114 pushes out the corresponding plunger 116 to the front, whereby the coupling member 112 is pushed to the front and the corresponding one of the movable shades 102, 104, 106 rotates about the rotational shaft 99 such that the upper end thereof downwardly moves to the rear.

The shade unit 100 has an opening stopper (not shown). Each of the movable shades 102, 104, 106 is restricted from continuing to rotate downwards by hitting the opening stopper. When the movable shades 102, 104, 106 are moved downward, the corresponding part of the light, which is reflected by the reflector 24, is allowed to enter the projection lens 28. Hereinafter, for each of the movable shades 102, 104, 106, a position where the movable shade is rotated downward to be in abutment with the opening stopper is referred to as an "open position."

When all of the movable shades 102, 104, 106 are in the closed positions, the low beam light distribution pattern PL is formed, and the cutoff line thereof is formed by the boundary shade 70. The region above the cutoff line is not irradiated. When the first movable shade 102 is moved to the open position, the corresponding part of the light, which is reflected by the reflector 24, is allowed to enter the projection lens 28 to irradiate the middle section PHM on an imaginary vertical screen. When the second movable shade 104 is moved to the open position, the corresponding part of the light, which is reflected by the reflector 24, is allowed to enter the projection lens 28 to irradiate the right section PHR on the imaginary vertical screen. When the third movable shade 106 is moved to the open position, the corresponding part of the light, which is reflected by the reflector 24, is allowed to enter the projection lens 28 to irradiate the left section PHL on the imaginary vertical screen.

As described above, each of the movable shades 102, 104, 106 is rotatable about the horizontal shaft 99 which is perpendicular to the optical axis X so as to move between the closed position and the open position. Each of the movable shades 102, 104, 106 is rotatable such that the upper end thereof downwardly moves to the rear. According to the rotating movement of the movable shades 102, 104, 106, it is also possible to block the light from entering the projections lens 28 and to allow the light to enter the projection lens 28. Like in the first exemplary embodiment, a vehicle on which the lamp unit 20B is mounted may also have an intermediate beam mode.

Third Exemplary Embodiment

Figure 10:
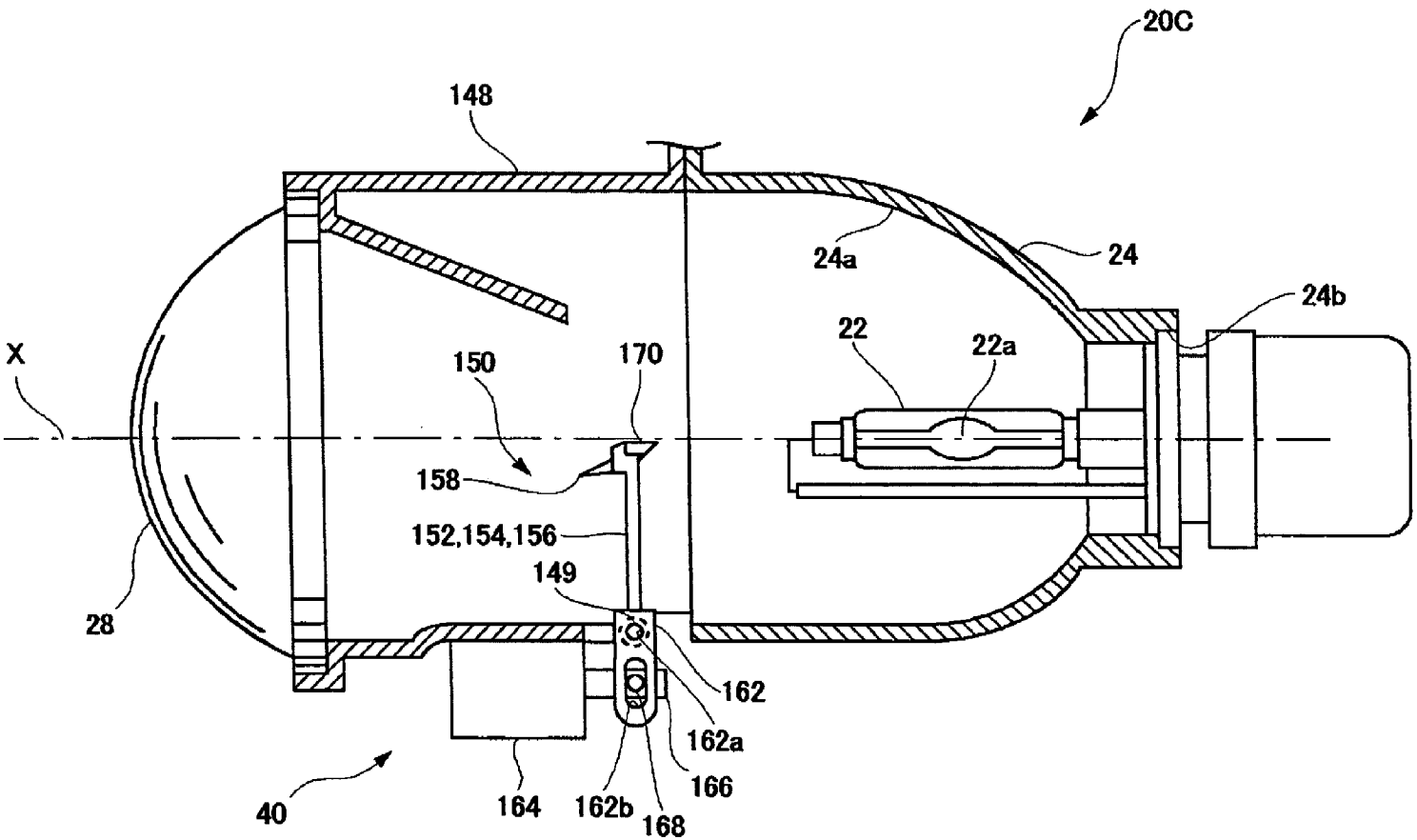
FIG. 10 is a sectional view of a lamp unit according to a third exemplary embodiment of the present invention.

FIG. 10 is a sectional view of a lamp unit 20C according to a third exemplary embodiment of the present invention. The sectional view is taken along a vertical plane including an optical axis X, and is viewed from the left of the lamp unit 20C. Hereinafter, portions of the lamp unit 20C that are similar to those of the lamp units 20A, 20B described above will be designated by the same reference numerals, and detailed explanation thereof will be omitted.

The lamp unit 20C has a similar configuration to that of the lamp unit 20A, except that a shade unit 150 is provided instead of the shade unit 50 and that a holder 148 is provided instead of the holder 26. The shade unit 150 includes a first movable shade 152, a second movable shade 154, a third movable shade 156, an auxiliary reflector 158, solenoids 164, and a boundary shade 170.

Figure 11:
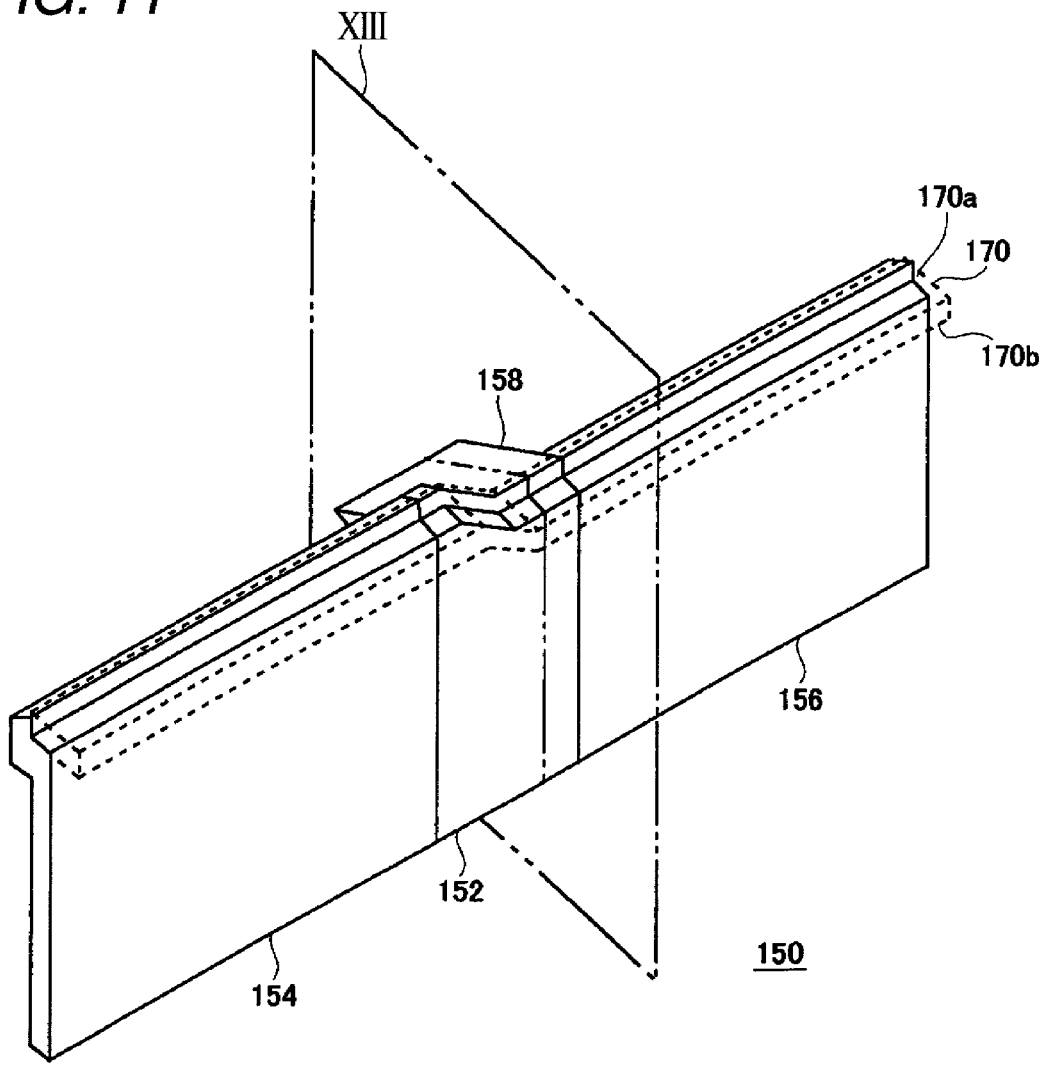
FIG. 11 is a partial perspective view of a shade unit of the lamp unit of FIG. 10.

FIG. 11 is a partial perspective view of the shade unit 150. The boundary shade 170 is formed in a shape of an elongated narrow plate, and there is a level difference on respective sides of an inclined portion which is provided substantially at a center of the boundary shade 170 in a longitudinal direction of the boundary shade 170. The movable shades 152, 154, 156 are formed in rectangular shapes having different outlines. The auxiliary reflector 158 is fixed to a front surface of the first movable shade 152. The second movable shade 154 is disposed on the left of the first movable shade 152, and the third movable shade 156 is disposed on the right of the first movable shade 152.

The boundary shade 170 is disposed to extend in a horizontal direction. The boundary shade 170 has an upper surface (a boundary surface 170*a*) and a lower surface 170*b*. The boundary surface 170*a* has an inclined portion in the middle, a left portion which horizontally extends from a left end of the inclined portion, and a right portion which horizontally extends from a right end of the inclined portion at a height which is lower than the left portion. A thickness from the boundary surface 170*a* to the lower surface 170*b* is uniform along the entire length of the boundary shade 170. Accordingly, the lower surface 170*b* also has a left portion and a right portion which horizontally extend at different levels on respective sides of an inclined portion.

An upper end of the first movable shade 152 has an inclined portion which matches the inclined portion of the lower surface 170*b* of the boundary shade 70. The first movable shade 152, the second movable shade 154 and the third movable shade 156 are provided side by side in a right-and-left direction such that upper ends (distal ends) thereof match the lower surface 170*b*.

As shown in FIG. 10, a coupling member 162 is fixed to a lower end of each of the movable shades 152, 154, 156. Each of the coupling members 162 is an elongated narrow plate member, and is formed with a shaft hole 162*a* penetrating the coupling member 162 in the right-and-left direction.

A lower part of the holder 148 is formed with an opening where a rotational shaft 149 is attached to the holder 148 to horizontally extend in a direction perpendicular to the optical axis X. The rotational shaft 149 is inserted into the shaft holes 162*a* of the coupling members 162 which are attached to the respective movable shades 152, 154, 156. Accordingly, each of the movable shades 152, 154, 156 is individually rotatable about the rotational shaft 149.

The solenoids 164 are associated with corresponding ones of the movable shades 152, 154, 156. The solenoids 164 are fixed to a lower surface of the holder 148 such that plungers 166 thereof extend to the rear. A pin 168 is fixed to a distal end portion of the plunger 166 to extend in the right-and-left direction. The pin 168 is inserted into a slot 162*b* of the corresponding coupling member 162. When the solenoid 164 is activated, the solenoid 164 pushes out the corresponding plunger 166 to the rear, so that the coupling member 162 is also pushed out to the rear and the corresponding one of the movable shades 152, 154, 156 is rotated about the rotational shaft 149 such that the upper end thereof downwardly moves to the front.

Figure 12:
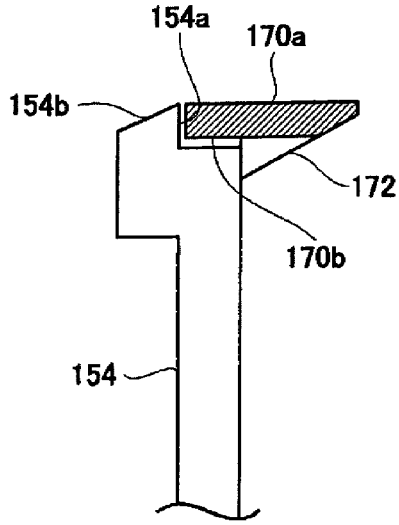
FIG. 12 is a left side view of a second movable shade of the shade unit shown in FIG. 11.

FIG. 12 is a left side view of the second movable shade 154. The second movable shade 154 has an overlap portion 154*a* on the upper end thereof. The overlap portion 154*a* is disposed so as to cover a gap between the lower surface 170*a* of the boundary shade 170 and the upper end of the second movable shade 154 from the front. Overlap portions, which are similar to this overlap portion 154*a*, are also provided on the first movable shade 152 and the third movable shade 156 respectively. According to this configuration, the leakage of light from the gap between the lower surface 170*b* of the boundary shade 170 and the upper ends of the respective movable shades 152, 154, 156 toward the projection lens 28 can be suppressed. The overlap portions may be provided on the boundary shade 170 instead of the movable shades 152, 154, 156 to similarly suppress the leakage of light from the gap between the lower surface 170*b* of the boundary shade 170 and the respective movable shades 152, 154, 156.

In addition, an inclined portion 154*b* is formed on the upper end of the second movable shade 154 so as to downwardly extend toward the front. Similar inclined portions are also provided on the first movable shade 152 and the third movable shade 156 respectively. By providing these inclined portions, the light reflected by the reflector 24 is prevented from being blocked by the upper ends of the respective movable shades 152, 154, 156.

A plurality of closing stoppers 172 are provided on the lower surface 170*b*. Positions of the closing stoppers 172 in the right-and-left direction are similar to those of the closing stoppers 72 in the first exemplary embodiment. The closing stoppers 172 are brought into abutment with rear surfaces of upper end portions of the respective movable shades 152, 154, 156, so as to restrict the movable shades 152, 154, 156 from continuing to rotate to the rear. Hereinafter, for each of the movable shades 152, 154, 156, a position where the movable shade is in abutment with the corresponding stoppers 172 will be referred to as a "closed position."

The shade unit 150 has an opening stopper (not shown), and each of the movable shades 152, 154, 156 is restricted from continuing to rotate downwards by hitting the opening stopper. When one ore more of the movable shades 152, 154, 156 is moved downward, the corresponding part of the light, which is reflected by the reflector 24, is allowed to enter the projection lens 28. Hereinafter, for each of the movable shades 152, 154, 156, a position where the movable shade is rotated downward to be in abutment with the opening stopper is referred to as an "open position."

When all of the movable shades 152, 154, 156 are in the closed positions, the low beam light distribution pattern PL is formed, and the cutoff line of the low beam light distribution pattern PL is formed by the boundary shade 170. A region above the cutoff line is not irradiated. When the first movable shade 152 is moved to the open position, the corresponding part of the light, which is reflected by the reflector 24, is allowed to enter the projection lens 28 to irradiate the middle section PHM on an imaginary vertical screen. When the second movable shade 154 is moved to the open position, the corresponding part of the light, which is reflected by the reflector 24, is allowed to enter the projection lens 28 to irradiate the right section PHR on the imaginary vertical screen. When the third movable shade 156 is moved to the open position, the corresponding part of the light, which is reflected by the reflector 24, is allowed to enter the projection lens 28 to irradiate the left section PHL on the imaginary vertical screen.

Figure 13A:
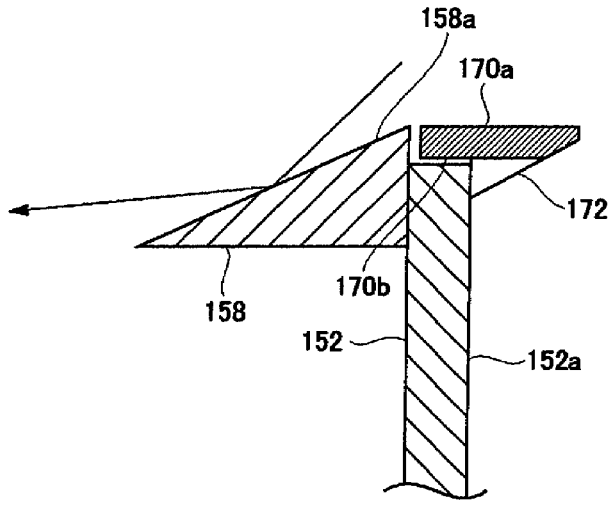
FIG. 13A is a sectional view of the shade unit taken along a vertical plane S in FIG. 11, illustrating a first movable shade in a closed position.

FIG. 13A is a sectional view of the first movable shade 152 in the closed position, taken along a vertical plane S in FIG. 11 and viewed from the left. The vertical plane S is parallel to the optical axis X The auxiliary reflector 158 is rectangular when viewed from above. The auxiliary reflector 158 has an auxiliary reflecting surface 158*a* which is inclined downwards toward the front. The auxiliary reflecting surface 158*a* is formed by, for example, an aluminum deposition. As shown in FIG. 13A, an overhead sign region can be irradiated with the light reflected by the auxiliary reflecting surface 158*a*, like the auxiliary reflecting surface 66*a* of the first exemplary embodiment.

The lower surface 170*b* of the boundary shade 170 is mirror finished by, for example, an aluminum deposition to functions as a reflecting face. When one of the movable shades 152, 154, 156 is in the closed position, the corresponding part of the light is blocked from entering the projection lens 28. On the other hand, when one of the movable shades 152, 154, 156 is in the open position, the corresponding part of the light is partially reflected by the lower surface 170*b* to enter the projection lens 28. By utilizing the lower surface 170*b* as the reflecting face, a portion of a projected image which corresponds to the boundary shade 170 is suppressed from being dark.

Figure 13B:
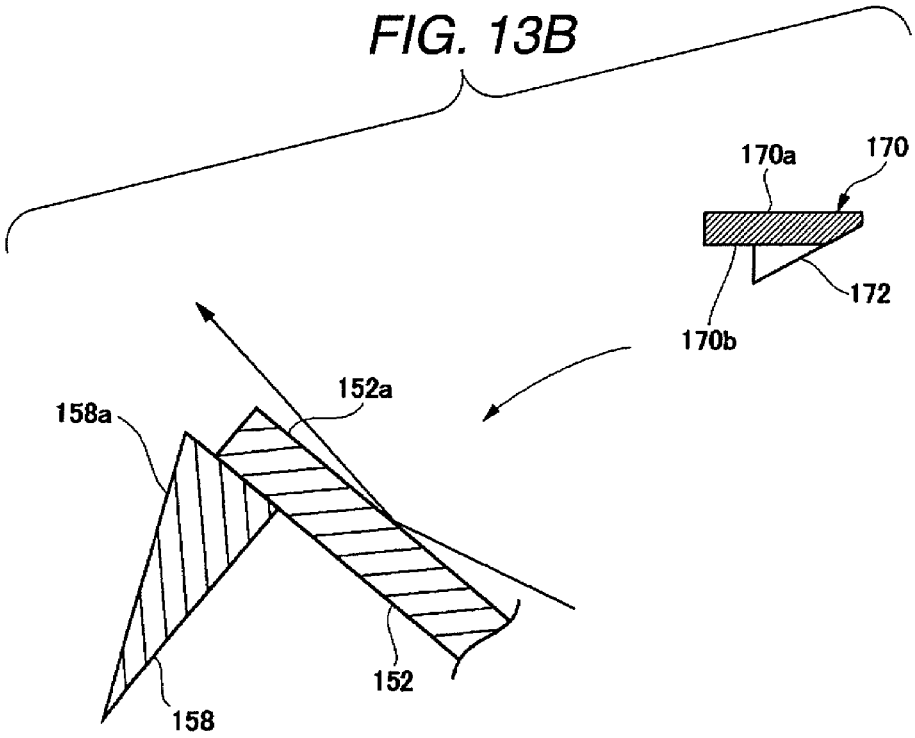
FIG. 13B is another sectional view of the shade unit taken along the vertical plane S in FIG. 11, illustrating the first movable shade in an open position.

FIG. 13B is a sectional view of the first movable shade 152 in the open position, taken along the vertical plane S shown in FIG. 11 and viewed from the left. In the third exemplary embodiment, a rear surface 152*a* of the first movable shade 152 is also mirror finished by, for example, an aluminum deposition to function as a reflecting face. When the first movable shade 152 is in the open position, the rear surface 152*a* reflects the light from the reflector 24 toward the projection lens 28 to irradiate the overhead sign region.

As described above, when the first movable shade 152 is in the closed position, the auxiliary reflecting surface 158*a* of the auxiliary reflector 158 reflects the light from the reflector 24 to irradiate the overhead sign region. On the other hand, when the first movable shade 152 is in the open position, the rear surface 152*a* of the first movable shade 152 reflects the light from the reflector 24 to irradiate the overhead sign region. Accordingly, it is possible to irradiate the overhead sign region, irrespective of whether the first movable shade 152 is in the closed position or in the open position.

As described above, each of the movable shades 152, 154, 156 is rotatable about the horizontal shaft 149 which perpendicular to the optical axis X to move between the closed position and the open position. The movable shades 152, 154, 156 are rotatable such that the upper ends thereof downwardly move to the front. According to this rotating movement of the movable shades 152, 154, 156, it is also possible to block the light from entering the projections lens 28 and to allow the light to enter the projection lens 28. Like in the first exemplary embodiment, a vehicle on which the lamp unit 20C is mounted may also have an intermediate beam mode.

While the present invention has been shown and described with reference to certain exemplary embodiments thereof, it will be understood by those skilled in the art that various changes in form and details, including combinations of the components of the exemplary embodiments, may be made therein without departing from the spirit and scope of the present invention as defined by the appended claims.

What is claimed is:

1. A vehicle headlamp comprising:

a light source;

an image forming section which forms a light image using light from the light source; and a projection lens which projects the light image, wherein an optical axis extends from the light source and passes through the projection lens, wherein the image forming section comprises:

a plurality of movable shades which are arranged side by side, each of the movable shades being individually movable between a closed position at which the movable shade blocks a corresponding part of the light from entering the projection lens and an open position at which the movable shade allows the corresponding part of the light to enter the projection lens, each of the movable shades comprising a distal end;

a boundary shade which is disposed to extend along the distal ends that are arranged side by side when the plurality of movable shades are in the closed positions, wherein, when the plurality of movable shades are in the closed positions, the boundary shade forms a boundary line of the light image; and a controller that determines whether a vehicle ahead of the headlamp is in a region corresponding to one of the plurality of movable shades, and controls the one of the movable shades so that it is in the closed position if the vehicle is in the region corresponding to the one of the plurality of movable shades.

2. The vehicle headlamp according to claim 1, wherein, when the plurality of movable shade are in the closed positions, the boundary shade and at least one of the movable shades overlap with each other in a direction along the optical axis.

3. The vehicle headlamp according to claim 1, wherein the boundary shade comprises a reflecting face which, when at least one of the plurality of movable shades is in the open position, partially reflects the corresponding part of the light toward the projection lens, and when said at least one of the plurality of movable shades is in the closed position, said at least one of the plurality of movable shades blocks the corresponding part of the light from being reflected by the reflecting face.

4. The vehicle headlamp according to claim 1, wherein each of the plurality of movable shades is configured to be movable in a direction intersecting the optical axis.

5. The vehicle headlamp according to claim 1, wherein the image forming section further comprises a shaft which extends in a direction perpendicular to the optical axis, wherein each of the plurality of movable shades is configured to be rotatable about the shaft.

6. A vehicle headlamp comprising:

a light source and a projection lens both arranged along an optical axis;

a plurality of movable shades, each of which are individually movable between a closed position and an open position, and are biased into the closed position, the plurality of movable shades being provided between the light source and the projection lens and arranged side by side in a direction orthogonal to the optical axis when in the closed position;

a boundary shade which is shaped to correspond to a distal contour of the movable shades when the movable shades are in the closed position, the boundary shade being positioned along the distal contour of the movable shades to form a boundary line of a light image projected by the projection lens when the movable shades are in the closed position; and an auxiliary reflector which is disposed on a portion of at least one of the plurality of movable shades, the auxiliary reflector extending from the at least one movable shade toward the projection lens.

7. The vehicle headlamp according to claim 6, further comprising:

means for individually moving the plurality of movable shades from the closed position to the open position.

8. A vehicle headlamp comprising:

a light source and a projection lens both arranged along an optical axis;

a first movable shade, a second movable shade, and a third movable shade, each of which are individually movable between a closed position and an open position, the first, second, and third movable shades being provided between the light source and the projection lens, and the first movable shade being provided between the second movable shade and the third movable shade arranged side by side in a direction orthogonal to the optical axis when the first, second, and third movable shades are in the closed position;

a boundary shade which is shaped to correspond to a distal contour of the first, second, and third movable shades when the first, second, and third movable shades are in the closed position, the boundary shade extending in the direction orthogonal to the optical axis along the distal contour of the first, second, and third movable shades to form a boundary line of a light image projected by the projection lens when the first, second, and third movable shades are in the closed position;

a plurality of solenoids, one solenoid provided for each of the first, second, and third movable shades and arranged to move the corresponding movable shade from the closed position to the open position; and an auxiliary reflector provided on the first movable shade and extending from the first movable shade toward the projecting lens such that when the first movable shade is in the closed position, the auxiliary reflector reflects light to irradiate an overhead sign region above the boundary line.

9. The vehicle headlamp according to claim 8, further comprising a plurality of overlap portions which cover a vertical boundary line between the first movable shade and the second movable shade, and a vertical boundary line between the first movable shade and the third movable shade.

10. The vehicle headlamp according to claim 9, wherein the second movable shade comprises an overlap portion of the plurality of overlap portions, and the third movable shade comprises another overlap portion of the plurality of overlap portions.

* * * * *